US005775083A

United States Patent [19]

Stahlecker et al.

[11] Patent Number: 5,775,083

[45] Date of Patent: Jul. 7, 1998

[54] SPINDLE FOR A SPINNING OR A TWISTING MACHINE

[75] Inventors: Gerd Stahlecker, Eislingen/Fils; Hans Braxmeier, Süssen, both of Germany

[73] Assignee: Novibra GmbH, Suessen, Germany

[21] Appl. No.: 705,312

[22] Filed: Aug. 29, 1996

[30] Foreign Application Priority Data

Sep. 15, 1995 [DE] Germany ..... 195 34 339.5

[51] Int. Cl.[6] ..... D01H 7/08

[52] U.S. Cl. ..... 57/135; 57/136; 384/228; 384/230; 384/233

[58] Field of Search ..... 57/133, 134, 135, 57/136; 384/226, 227, 228, 230, 231, 233, 234, 239

[56] References Cited

U.S. PATENT DOCUMENTS

| | | | |
|---|---|---|---|
| 3,095,687 | 7/1963 | Beerli | 57/134 |
| 3,485,029 | 12/1969 | Beerli | 57/134 |
| 3,920,291 | 11/1975 | Wendel et al. | 57/135 X |
| 4,731,985 | 3/1988 | Menegatto | 57/135 |

FOREIGN PATENT DOCUMENTS

| | | | |
|---|---|---|---|
| 422413 | 4/1991 | European Pat. Off. | 57/135 |
| 2114779 | 8/1972 | Germany . | |
| 2348908 | 4/1975 | Germany | 57/135 |
| 4235050 | 4/1994 | Germany | 57/135 |
| 99305 | 6/1990 | Romania . | |
| 976444 | 11/1964 | United Kingdom | 57/135 |

*Primary Examiner*—William Stryjewski
*Attorney, Agent, or Firm*—Evenson McKeown Edwards & Lenahan, PLLC

[57] ABSTRACT

A spindle for spinning or twisting machines comprises a rigid inner sleeve which contains a neck bearing and a step bearing for a rotatably supported shaft and which inner sleeve is accommodated in a bearing housing, the bearing housing being fixed to a spindle rail. The inner sleeve is supported against the bearing housing by two radially symmetrical acting metal springs. The spring rate of the metal spring which faces the neck bearing amounts to at least five times and at most twenty times the spring rate of the metal spring facing the step bearing. The ring space between the inner sleeve and the bearing housing is filled with a highly viscous fluid. The inner sleeve is closed off against the ring space with an oilproof seal.

25 Claims, 3 Drawing Sheets

SPINDLE FOR A SPINNING OR A TWISTING MACHINE

BACKGROUND AND SUMMARY OF THE INVENTION

The present invention relates to a spindle for spinning or twisting machines comprising a rigid inner sleeve which takes up a neck bearing and a step bearing for a rotatably supported shaft, the said inner sleeve being accommodated in a bearing housing fixed to a spindle rail and being supported against the bearing housing by two radially symmetrical acting metal springs disposed at a distance to one another, of which springs one is arranged in close proximity to the neck bearing and the other in close proximity to the step bearing.

In the case of a spindle of this type (U.S. Pat. No. 3,798,888) the spring arranged adjacent the neck bearing is a metal disc of uniform thickness, whose radial elasticity is determined essentially by a stamped, concentrical spiral slot. This slot begins in close proximity to a central bore hole and ends near to the outer circumference of the disc. The other metal spring is a spring wire whose one end is fixed eccentrically in the step bearing and whose other end is fixed in the bottom of the bearing housing. The spring wire has a horizontal coil spring section consisting only of a few windings, and therefore also gives in radial direction. A damping spiral is located in the ring space between the inner sleeve and the bearing housing. The published patent states specifically that the spring constants of the two metal springs are as low as possible, so that the inner sleeve is connected to the bearing housing with great elasticity. Ratios between the spring constants are not given.

In the case of another spindle of this type (Romanian published patent 99 305) , for metal springs, two identical finger springs are located between the inner sleeve and the bearing housing, which finger springs consist of a tube-shaped area and resilient tongues adjacent thereto. The finger spring arranged adjacent the step bearing surrounds same with its resilient tongues, while with its tube-shaped area it is placed on a bolt co-axially arranged adjacent the step bearing. The finger spring arranged adjacent the neck bearing is fixedly connected with its tube-shaped area to the bearing housing and is supported from the outside against the inner sleeve by means of its resilient tongues. A damping spiral is located in the ring space between the bearing housing and the inner sleeve. Ratios between the spring rates are not given.

It is an object of the present invention to make a spindle of the above mentioned type whose shaft executes radial movements as is the case with known standard spindles. Standard spindles have a neck bearing securely fixed in the bearing housing and a step bearing supported in a resilient centering tube. In addition, the structure-borne noise emanating from the neck bearing should be effectively dampened and be prevented as far as possible in communicating itself to the bearing housing.

The object has been achieved in accordance with the present invention in that the spring rate of the metal spring facing the neck bearing amounts to at least five times and at most twenty times the spring rate of the metal spring facing the step bearing.

In contrast to the above described prior art, the rigid inner sleeve is relatively rigidly supported against the bearing housing. In the area of the step bearing, however, the inner sleeve can carry out wider wandering radial movements due to the significantly reduced spring rate of the metal spring located there. The two metal springs act each as a discontinuity point between the inner sleeve and the bearing housing, whereby the structure-borne noise emanating in particular from the neck bearing is effectively dampened, so that it is not transmitted through the bearing housing to the spindle rail. An oscillation pattern arises for the shaft as a whole, as was the case for the standard spindles described above with resilient centering tube and securely fixed neck bearing.

The metal springs are so arranged that they border the ring space located between the inner sleeve and the bearing housing at both front ends. This leads to the largest possible distance between the two metal springs. The ring space is advantageously filled with a highly viscous fluid. As a fluid, a silicon oil of very high viscosity, for example, can be used. This highly viscous fluid acts as a damping means between the rigid inner sleeve and the bearing housing, so that the usual damping spirals can be omitted.

As the shaft of the spindle rotates in oil, the ring space is closed off with an oilproof seal from the interior of the inner sleeve. In contrast, in the above described prior art the ring space was connected to the inner sleeve, so that both spaces were filled with the same oil.

In order to be able to use metal springs with approximate tolerances, with the aim of reducing production costs, in a further embodiment of the invention a rigid inner sleeve is provided with can be adjusted in relation to the bearing housing. To this purpose, the metal spring facing the step bearing is radially adjustable.

Various forms of spring elements can basically be considered as metal springs, but for the purpose of the invention, it is preferably provided that both metal springs are of the same type of spring element, whereby there is a large difference in spring rates between the two.

In a preferred embodiment, the metal springs can take the form of a wound flat spiral spring. These are supported with their inner sides on the rigid inner sleeve and with their outer sides on the bearing housing or on a component connected thereto. These wound flat spiral springs are apparently generally similar to the known damping spirals, but have, however, in contrast thereto the difference that the distances between the windings of the spirals are significantly greater.

In another embodiment the metal springs take the form of coil springs. Although this type of coil spring is usually effective first and foremost in axial direction, they give to a certain extent also in radial direction, in particular when between the upper and lower fixing point a few free windings are present. Metal springs in this form are particularly cost-effective to produce.

In a further embodiment, the metal springs can take the form of finger springs which consist of a tube-shaped area and spring tongues adjacent thereto, as described above in prior art. This type of finger spring has the advantage that after a radial rebound, the restoring force becomes effective only there where radial wandering movement was present.

These and further objects, features and advantages of the present invention will become more readily apparent from the following detailed description thereof when taken in conjunction with the accompanying drawings wherein:

DETAILED DESCRIPTION OF THE DRAWINGS

Figure 1:
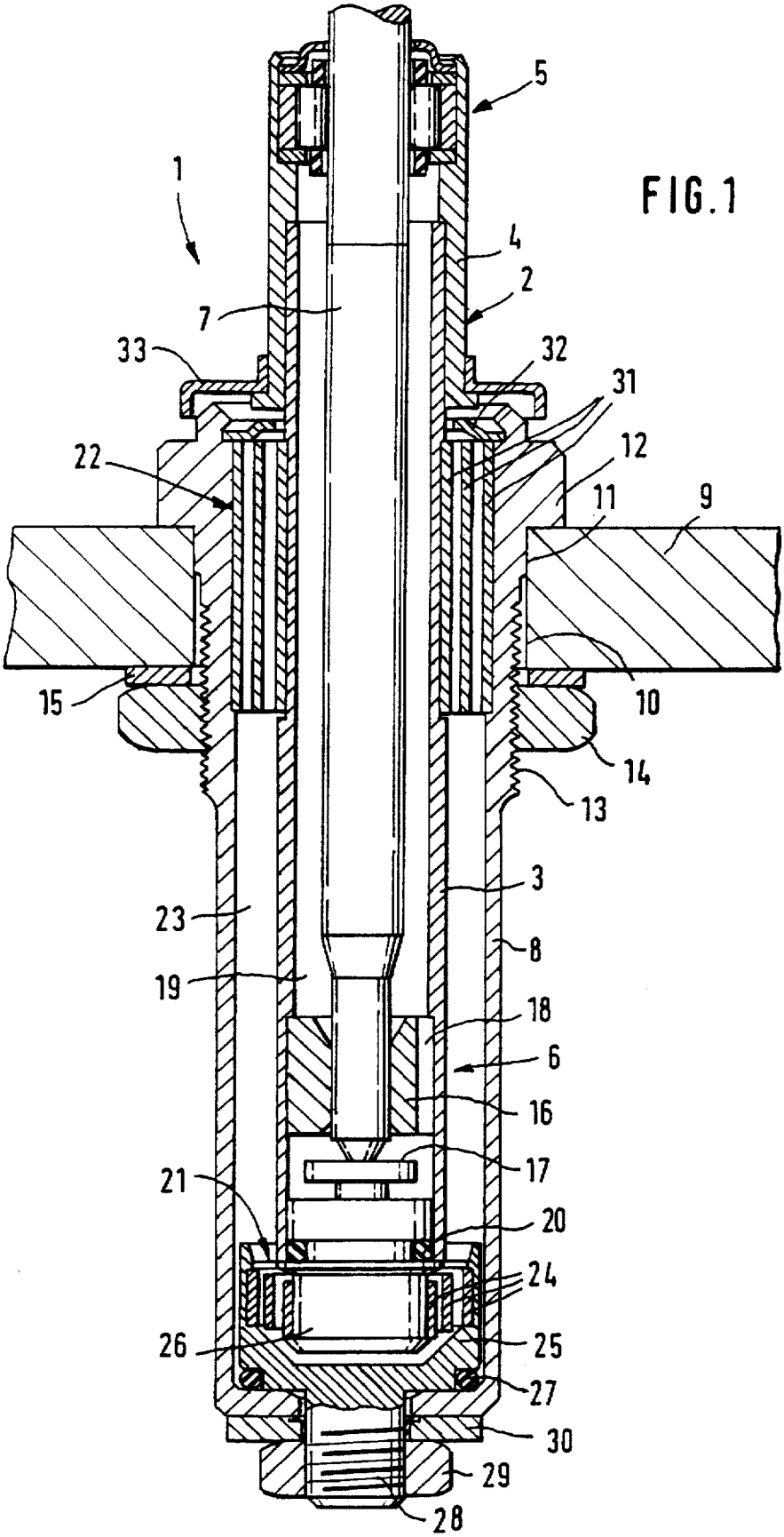
FIG. 1 is an axial section through the spindle of the present invention, whereby the metal springs take the form of flat spiral springs.

The spindle as a whole is denoted by 1 and comprises a rigid inner sleeve 2, which, in this case is composed of two parts, namely a lower guide sleeve 3 and an upper tube-shaped bearing head 4 pressed onto the guide sleeve 3. The neck bearing 5 in the form of a roller bearing is supported by the relatively rigid bearing head 4 of the inner sleeve 2. The two-part step bearing 6 is held in the guide sleeve 3 of the inner sleeve 2 and will be described below.

The shaft 7 of the spindle 1 is rotatably mounted in the neck bearing 5 and the step bearing 6. The spindle upper part (not shown) is located above the neck bearing 5 of the vertically arranged spindle 1; the spindle upper part usually takes up a tube for the winder. The shaft 7 is connected to a drive wharve above the neck bearing 5 in a known way, which drive wharve is driven by a drive belt (not shown). The arrangement is such that the transverse force of the drive belt is taken up directly by the neck bearing 5.

The very rigid inner sleeve 2 is accommodated in a tube-shaped bearing housing 8, which can be affixed directly to a spindle rail 9 without the intervention of elastic elements. The spindle rail 9 has a through bore hole 10, through which the bearing housing 8 can be placed from above. The bearing housing 8 is provided in its upper area with a centering collar 11 with close tolerances, so that the centering collar 11 fits in the through bore hole 10 with an absolute minimum of free play. The bearing housing 8 is supported on the spindle rail 9 from above by means of a radial flange 12. Downwards, adjacent to the flange 12, the bearing housing 8 is provided with an outside thread 13, which can take up a fastening nut 14. With the aid of a plain washer 15, the fastening nut 14 attaches the bearing housing 8 with the spindle rail 9.

The step bearing 6 comprises a step bearing sleeve 16, which is pressed into the lower area of the guide sleeve 3 of the inner sleeve 2 and which takes up radial forces. The shaft 7 is supported axially on a thrust pad 17, which is also taken up by the inner sleeve 2. The step bearing sleeve 16 comprises a plurality of oil grooves 18 extending continuously in axial direction so that the interior 19 of the inner sleeve 2 is supplied with oil above and below the step bearing sleeve 16. Towards the bottom, the interior 19 is sealed off by means of an oilproof ring seal 20, so that outside of the interior 19 of the inner sleeve 2 no oil is present.

The rigid inner sleeve 2 is supported against the bearing housing 8 by two metal springs 21 and 22, which are at the largest possible distance away from each other and which act radially symmetrical. In order to achieve a pattern of oscillation corresponding to that of the standard spindles described above, the spring rate of the metal spring 22 facing the neck bearing 5 is at least five times as high and at most twenty times as high as the spring rate of the metal spring 21 facing the step bearing 6. The result of this is that the shaft 7, in the area of the step bearing 6, displaces radially more than in the area of the neck bearing 5. The purpose of the latter is particularly important because it prevents the drive belt (not shown) arranged in the area of the neck bearing 5 from making too large transverse movements.

The ring space 23, located between the inner sleeve 2 and the bearing housing 8, and bordered at both its front ends by the metal springs 21 and 22, is filled with a highly viscous fluid, for example with a silicon oil of a high viscosity. This highly viscous fluid acts as a damping means, so that in the ring space 23, all damping spirals can be omitted.

The metal spring 21 arranged in the area of the step bearing 6 is formed as a wound flat spiral spring 24, whose windings are at a certain distance away from each other. Because of the required spring rate, which is significantly lower in comparison to that of the metal spring 22, the axial extent of the flat spiral spring 24 is small. The outer windings are arranged in a shell 25, which is directly connected to the bearing housing 8. The inner windings of the flat spiral spring 24 are supported on a bolt 26, which is connected directly to the guide sleeve 3 of the inner sleeve 2 through the medium of the above mentioned ring seal 20. The bolt 26 can be made in one piece with the thrust pad 17.

Between the shell 25 and the floor of the bearing housing 8 there is a further ring seal 27, so that there is no risk that the highly viscous fluid in the ring space 23 comes into contact with the oil in the interior 19.

The shell 25 is connected to a threaded stem 28 which is placed with clearance through a bore hole in the bottom of the bearing housing 8. The threaded stem 28 takes up a fixing nut 29, which fixes the shell 25 to the bearing housing 8 with the aid of a plain washer 30. The shell 25 can be moved radially after the fixing nut 29 has been released, so that the inner sleeve 2 and the shaft 7 can be adjusted in relation to the bearing housing 8. In order that this be carried out with more ease, the plain washer 30 is pressed securely onto the threaded stem 28 and provided with working surfaces for a machine tool on its outer side. The inner sleeve 2 can thus be pressed by simple means into the correct position, whereby the position is fixed by tightening the fixing nut 29.

The metal spring 22 facing the neck bearing 5 is also in the form of a wound flat spiral spring 31, but with, however, a significantly longer axial extent than the flat spiral spring 24.

Thus the required stronger spring rate of the upper metal spring is taken first and foremost into consideration. The flat spiral spring 31 is disposed with its inner windings on the outside of the guide sleeve 3 of the inner sleeve 2, and with its outer windings from the inside on the bearing housing 8. A larger gap is left between the windings of the flat spiral spring 31, which gap is larger than in the case of standard damping spirals.

Above the flat spiral spring 31, the bearing housing 8 is covered by a protective cap 32. As an alternative or in addition, a cover 33 can be provided above the bearing housing 8.

In the following descriptions of embodiments of the present invention according to FIGS. 2 and 3, the same reference numbers are used as in FIG. 1, insofar as an identical component is involved. The embodiments will not be described again, as reference will be made to the corresponding description of FIG. 1. The following embodiments will thus be explained only insofar as they deviate from the embodiment according to FIG. 1.

Figure 2:
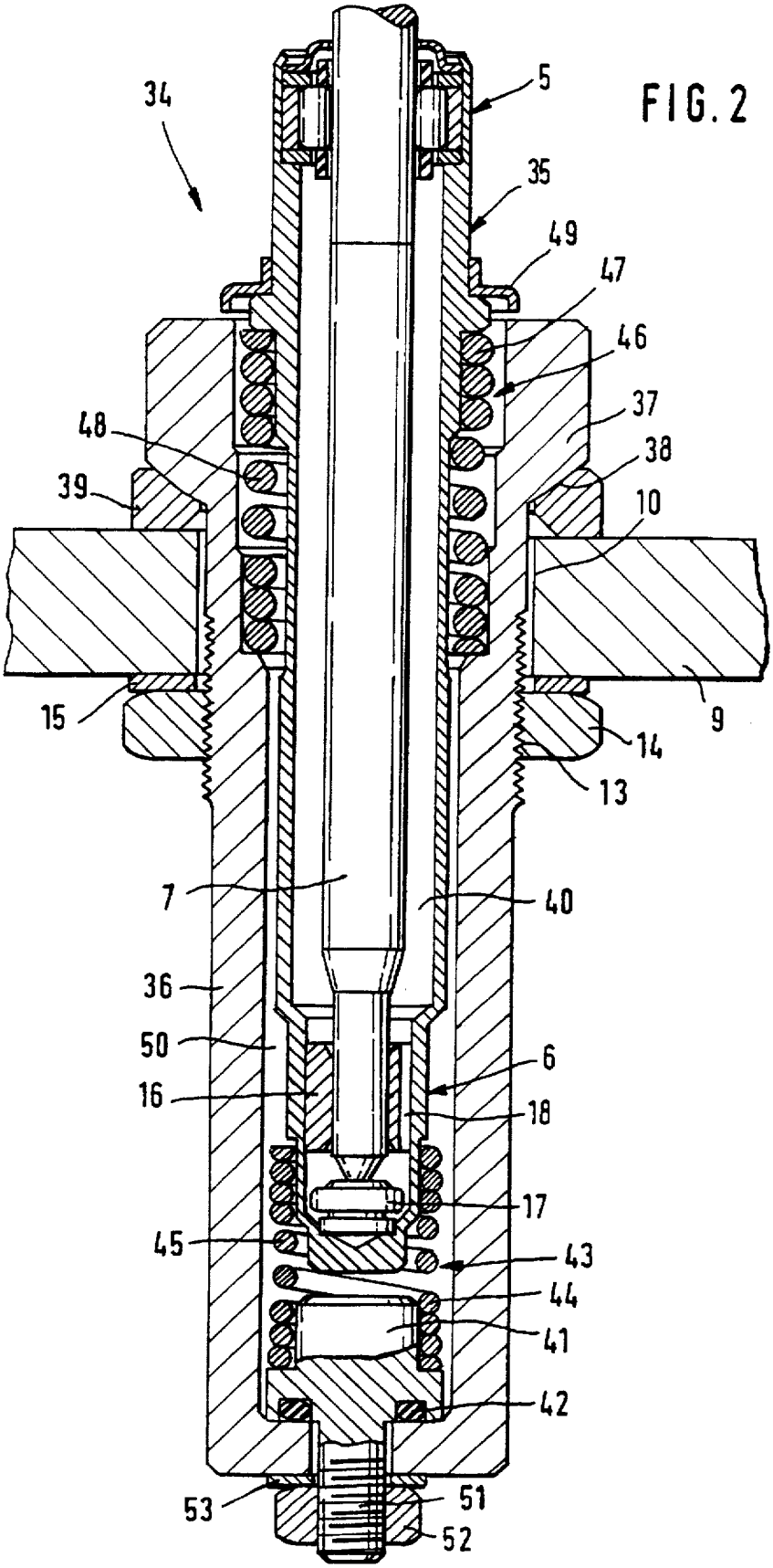
FIG. 2 is an axial section through another embodiment of the spindle of the present invention, whereby the metal springs take the form of coil springs.

The spindle, as a whole denoted by the reference number 34 according to FIG. 2, comprises a rigid inner sleeve 35, which in this embodiment is made in one piece. It therefore takes up the neck bearing 5 directly, without the aid of separate bearing head, and supports the step bearing 6 at the same time in its lower area. The inner sleeve 35 is accommodated in a bearing housing 36, which has a slightly different construction, and whose flange 37 is provided here with a ball cup 38. This ball cup 38 is disposed on a correspondingly shaped spherical washer 39, which in turn is supported on the spindle rail 9. With the aid of the ball cup 38, the bearing housing 36 can be adjusted vertically in relation to the spindle rail 9.

The interior 40 of the inner sleeve 35 which takes up the shaft 7 is filled with oil and provided with an oilproof seal, in this embodiment a sealed bottom end. The step bearing sleeve 16 has also in this case oil grooves 18.

In the area of the bottom of the bearing housing 36, a bolt 41 is provided, which is arranged co-axially to the shaft 7 and sealed off from the bottom of the bearing housing 36 with a ring seal 42.

The metal spring 43 facing the step bearing 6 is, in this embodiment, in the form of a coil spring 44, whose under windings lie on one another and are pressed onto the bolt 41. The upper windings of the coil spring 44 lie also on one another and are pressed onto the lower area of the inner sleeve 35. Between the two press fits of the coil spring 44 there are several free windings 45, so that a certain radial elasticity is present. The spring rate in radial direction is such that the inner sleeve 35 in the area of the step bearing 6 can move radially symmetrical in the desired way.

The upper metal spring 46 is also in the form of a coil spring 47, but with a significantly greater spring rate with respect to radial movements. Also in the case of the upper coil spring 47, which faces the neck bearing 5, the upper and lower windings lie on one another, with free windings 48 located in between, which permit radial movement.

The ring space 50, located between the bearing housing 36 and the inner sleeve 35, is covered upwards by a cover 49. Between the two coil springs 44 and 47, the ring space 50 is filled with a highly viscous fluid, which does not come into contact with the interior 40 of the inner sleeve 35.

The bolt 41, on which the lower coil spring 44 is supported, is extended downwards by a threaded stem 51, which is guided with clearance through the bottom of the bearing housing 36. The lower coil spring 44, and thus with it the inner sleeve 35, can thus be adjusted in relation to the bearing housing 36. Also, in this embodiment the adjusted position is secured with a fixing nut 52 with the aid of a plain washer 53 placed in an intermediary position.

Figure 3:
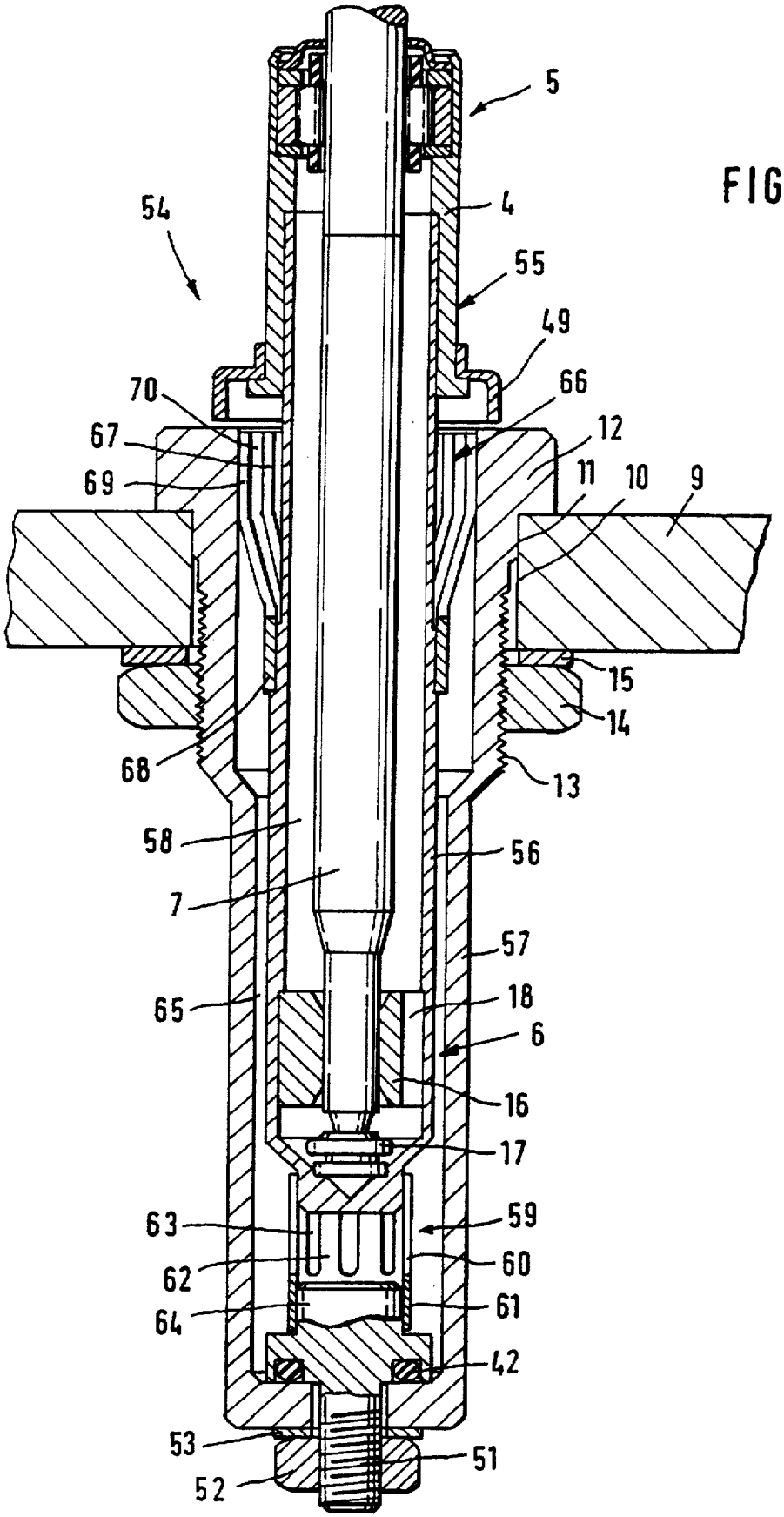
FIG. 3 is an axial section through a further embodiment of the spindle of the present invention, whereby the metal springs take the forms of finger springs.

In the embodiment according to FIG. 3, the shaft 7 of the spindle, denoted in its entirety by 54, is also supported in a two-part inner sleeve 55, which consists of a bearing head 4 and a guide sleeve 56. The interior 58 of the inner sleeve 55 is again filled with oil and sealed outwards with an oilproof seal.

The lower metal spring 59 facing the step bearing 6 is formed here as a so-called finger spring 60, which has a lower tube-shaped area 61 and individual spring tongues 62 adjacent thereto. The spring tongues 62 are separated from one another in circumferential direction by slots 63.

The tube-shaped area 61 is pressed onto a bolt 64 arranged co-axially to the shaft 7. The spring tongues 62 rest from the outside on the lower area of the guide sleeve 56 of the inner sleeve 55, so that the otherwise rigid inner sleeve 55 can move in radial direction in the desired way. With the aid of the threaded stem 51 and the fixing nut 52, the finger spring 60 can be aligned in relation to the bearing housing 57.

The upper metal spring 66 facing the neck bearing 5 consists also of a finger spring 67, which, because of the necessary significantly greater spring rate, is more strongly dimensioned. The finger spring 67 comprises a tube-shaped area 68, which is slid onto the guide sleeve 56 of the inner sleeve 55. The spring tongues 69 are here slightly bent outwards, and rest against the bearing housing 57 from the inside. Thus a radial movement, when somewhat limited, is possible for the area of the neck bearing 5. The spring tongues 69 of the upper finger spring 67 are separated from one another by slots 70 in circumferential direction.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spindle for spinning or twisting machines comprising a rigid inner sleeve which supports a neck bearing and a step bearing for a rotatably supported shaft and which is accommodated in a bearing housing, said bearing housing being connected to a spindle rail, the inner sleeve being supported against the bearing housing by first and second radially symmetrical acting metal springs disposed at a distance from one another, of which the first metal spring is closer to the neck bearing than to the step bearing and the second metal spring is closer to the step bearing than to the neck bearing, wherein the spring rate of the first metal spring amounts to between five times and twenty times the spring rate of the second metal spring.

2. A spindle according to claim 1, wherein the metal springs border a ring space located between the inner sleeve and the bearing housing at both respective ends of said ring space.

3. A spindle according to claim 2, wherein the ring space is filled with a highly viscous fluid.

4. A spindle according to claim 3, wherein the ring space is sealed off from the inner sleeve in an oilproof way.

5. A spindle according to claim 4, wherein the metal spring facing the step bearing is radially adjustable.

6. A spindle according to claim 3, wherein at least one of the metal springs is formed as a wound flat spiral spring.

7. A spindle according to claim 3, wherein at least one of the metal springs is formed as a coil spring.

8. A spindle according to claim 3, wherein at least one of the metal springs is formed as a finger spring.

9. A spindle according to claim 2, wherein the ring space is sealed off from the inner sleeve in an oilproof way.

10. A spindle according to claim 9, wherein at least one of the metal springs is formed as a wound flat spiral spring.

11. A spindle according to claim 9, wherein at least one of the metal springs is formed as a coil spring.

12. A spindle according to claim 9, wherein at least one of the metal springs is formed as a finger spring.

13. A spindle according to claim 2, wherein the metal spring facing the step bearing is radially adjustable.

14. A spindle according to claim 1, wherein the metal spring facing the step bearing is radially adjustable.

15. A spindle according to claim 1, wherein at least one of the metal springs is formed as a wound flat spiral spring.

16. A spindle according to claim 1, wherein at least one of the metal springs is formed as a coil spring.

17. A spindle according to claim 1, wherein at least one of the metal springs is formed as a finger spring.

18. A textile machine spindle shaft support bearing assembly comprising:

a bearing housing, an inner sleeve at the bearing housing, a neck bearing and a step bearing in the inner sleeve axially spaced from one another, a first spring radially supporting the inner sleeve at the housing in an area closer to the neck bearing than to the step bearing, and a second spring radially supporting the inner sleeve at the housing in an area adjacent the step bearing, wherein the first spring has a radial spring constant which is substantially higher than spring constant of the second spring whereby, in use, the inner sleeve moves radially over a wider range in the area of the step bearing than in the area of the neck bearing due to the reduced spring rate of the second spring as compared to the spring rate of the first spring.

19. A bearing assembly according to claim 18, wherein said first and second springs are metal springs.

20. A bearing assembly according to claim 18, wherein the radial spring constant of the first spring is between 5 and 20 times the radial spring constant of the second spring.

21. A bearing assembly according to claim 20, wherein said first and second springs are metal springs.

22. A bearing assembly according to claim 18, wherein axially facing end regions of the first and second springs border a ring space between the bearing housing and inner sleeve.

23. A bearing assembly according to claim 21, wherein axially facing end regions of the first and second springs border a ring space between the bearing housing and inner sleeve.

24. A bearing assembly according to claim 22, wherein the ring space is filled with a highly viscous fluid.

25. A bearing assembly according to claim 24, wherein the ring space is sealed off from the inner sleeve in an oilproof way.

* * * * *